US005445074A

United States Patent [19]

Malin et al.

[11] Patent Number: 5,445,074

[45] Date of Patent: Aug. 29, 1995

[54] VALUE SELECTION AND PRINTING APPARATUS INCLUDING A SECURITY DEVICE

[75] Inventors: Richard A. Malin, Westport; Pasquale Cuozzo; Stephen Rigo, both of Stamford, all of Conn.

[73] Assignee: Pitney Bowes Inc., Stamford, Conn.

[21] Appl. No.: 333,567

[22] Filed: Nov. 2, 1994

[51] Int. Cl.[6] ..... B41L 47/46

[52] U.S. Cl. ..... 101/91; 101/76; 101/110

[58] Field of Search ..... 101/76, 91, 92, 93, 101/99, 106, 110; 74/422, 411, 461; 235/101; 364/464.01

[56] References Cited

U.S. PATENT DOCUMENTS

| | | | |
|---|---|---|---|
| 3,682,378 | 8/1972 | Rouan et al. | 235/101 |
| 3,823,666 | 7/1974 | Hanson | 101/91 |
| 4,050,374 | 9/1977 | Check, Jr. et al. | 101/91 |
| 4,516,494 | 5/1985 | Beck et al. | 101/91 X |
| 4,604,950 | 8/1986 | Sette | 101/110 |
| 4,630,210 | 12/1986 | Salazar et al. | 364/464 |
| 4,649,814 | 3/1987 | Sette | 101/110 |
| 4,735,138 | 4/1988 | Gawler et al. | 101/91 |
| 5,050,495 | 9/1991 | Wu | 101/91 |
| 5,295,433 | 3/1994 | Malin | 101/91 |
| 5,372,065 | 12/1994 | Cuozzo et al. | 101/93 |

FOREIGN PATENT DOCUMENTS

| | | | |
|---|---|---|---|
| 2177656 | 1/1987 | United Kingdom | 101/91 |

*Primary Examiner*—Chris A. Bennett

*Attorney, Agent, or Firm*—Steven J. Shapiro; David E. Pitchenik; Melvin J. Scolnick

[57] ABSTRACT

A value selection and printing apparatus includes a printing device having a printing wheel; a movable rack gear operatively engaged with the printing wheel such that at times when the rack gear moves along a normal linear operative path of travel the printing wheel is repositioned, the rack gear including a stress concentration area where the rack gear deforms when subjected to a force sufficient to disassociate the printing wheel from the rack gear; and a device, interfering with the deformed rack gear, for preventing the deformed rack gear from traversing the normal linear operative path.

12 Claims, 3 Drawing Sheets

VALUE SELECTION AND PRINTING APPARATUS INCLUDING A SECURITY DEVICE

BACKGROUND

1. Field of the Invention

This invention relates to a value selection mechanism, and more particularly to a postage value selection mechanism including a security device for preventing the printing of postage without payment being made and for easily detecting tampering of the postage value selection mechanism.

2. Description of the Related Art

U.S. Pat. No. 4,050,374 for a METER SETTING MECHANISM, issued Sep. 27, 1977 to Check, Jr. and assigned to the assignee of the present invention and incorporated by reference herein, discloses a mechanism for selecting postage values which are to be printed by a rotary postage meter. The drive shaft of the drum includes a plurality of selectable racks, each of which is slidably movable in engagement with a different pinion gear, connected to an associated print wheel within the drum, for selectively rotating the print wheel to dispose a printing element or font thereof at the outer periphery of the drum for printing purposes. The value selection mechanism includes a first stepper motor which is operable for selecting one of the racks, and a second stepper motor which is operable for actuating the selected rack for selectively rotating the desired printing element of the associated print wheel to the printing position thereof. An electronic control system (not shown) which is coupled to a keyboard for processing postage value entries made by an operator, selectively drives the respective stepper motors in response to keyboard entries.

U.S. Pat. No. 4,630,210 for a MICROPROCESSOR CONTROLLED D.C. MOTOR FOR CONTROLLING A LOAD, issued Dec. 16, 1986 to Salazar, et al., and assigned to the assignee of the present invention and incorporated by reference herein, shows a conventional postage meter including a plurality of lengthwise translatable racks mounted in channels formed in the drive shaft of a rotatable postage printing drum. The drum includes a plurality of print wheels, which are mounted for rotation in the drum, and a like number of pinion gears connected on a one-for-one-basis with an associated print wheel. Each of the pinion gears is disposed, on a one for one basis, in meshing engagement with each of the rack gears, so that lengthwise translation of a rack gear results in rotation of the associated print wheel to a selected position thereof wherein a printing font at the periphery of the print wheel is located for printing purposes when the drum is rotated.

U.S. Pat. No. 4,649,814, for ROTARY SELECTOR DEVICE, issued Mar. 17, 1987 to Sette and assigned to the assignee of the present invention and incorporated by reference herein, shows a rotary value selection mechanism, of the type used for selecting and driving the respective translatable racks of the aforesaid U.S. Pat. No. 4,630,210, including a first annularly-shaped rack selection member having a pinion gear mounted therewithin and movable therewith for selectively engaging the racks as the first member is rotated, and including a second annularly-shaped printwheel font selection member which is disposed in meshing engagement with the pinion gear teeth for translating the selected rack to move the associated print wheel as the second member is rotated.

U.S. Pat. No. 3,682,378 for VALUE DISPENSING MECHANISMS, issued Aug. 8, 1972 to Rouan, et al. and assigned to the assignee of the present invention and incorporated herein by reference, shows a value selection mechanism whereby the plurality of print wheels are movable via a mechanical gear/lever arrangement.

Value selection mechanisms of the aforesaid types have from time-to-time become physically damaged such that one or more rack gears have become disassociated from its associated print wheel driving gear, with the result that the print wheels may be rotated independently thereof. Whereupon, a postage value can be printed which is different from that which has been selected by the associated, translating, rack gear. Although the occurrence of such physical damage may be apparent to a postage meter user, meters have been known to be continued to be used despite such a malfunction condition, in order to wrongfully print postage values without a payment being made therefor. Of course, since postage meters are required to be physically inspected on a semi-annual basis, and more frequently based on mail volume and postage, such physical damage has a short life span if it is discovered during the inspection. Nevertheless, any postage payment losses are rightfully of great concern to the Postal Service and to postage meter manufacturers. As a result, a series of experimental activities with postage meters have been conducted to determine the basic cause, if any, of disassociation of postage selecting racks and print wheels. And, it has been experimentally determined that the instances in which such disassociation's occur are due to a sufficient force being exerted against the print wheel to separate the same from the drive train therefor. Such a force could, for example, occur if someone tried to force movement of the printwheel in an attempt to print postage values without a payment being paid therefrom.

U.S. Pat. No. 5,295,433 for A VALUE SELECTION MECHANISM INCLUDING MEANS FOR WEAKENING A SHAFT THEREOF, issued Mar. 22, 1994 and assigned to the assignee of the present invention is incorporated by reference herein and discloses a device which solves, to some degree, the problems of the prior art discussed above. U.S. Pat. No. 5,295,433 shows a shaft mounted in a printhead drum and upon which a first gear rack is slidably mounted, via supporting elements, to a pinion gear associated with a print wheel. When the first gear rack is driven along the shaft due to interaction with a second gear rack, the pinion gear is forced into rotation thereby rotating the print wheel to position the selected printing element into a print position. The shaft upon which the first gear rack slides includes a circumferentially extending channel therein which acts as a weakened portion of the shaft. Thus, when a force tending to disassociate the print wheel from the first gear rack is applied to the print wheel, the shaft will permanently bend at the channel in response to the force. When bending occurs, the supporting elements of the first gear rack can no longer freely slide along the shaft, thereby jamming the value selection mechanism.

Copending U.S. patent application No. 08/308,044, entitled VALUE SELECTION AND PRINTING APPARATUS INCLUDING A SECURITY DEVICE and filed on Sep. 16, 1994, discloses yet another device for preventing the printing of incorrect postage.

This device utilizes a novel sleeve disposed around a weakened rack gear guide shaft which will jam when a force sufficient to disassociate the print wheel from the rack gear is exerted against the print wheel.

Copending U.S. patent application No. 08/085,382 filed Jul. 2, 1993 also discloses a security mechanism for a postage meter in which a rotatable drive gear deforms in response to a force applied thereto and thereby jams the printing mechanism.

SUMMARY OF THE INVENTION

It is an object of the invention to provide a security mechanism for the value selection means of a postage meter which is actuated in response to forces exerted on the print wheel tending to disassociate the print wheel from its drive train.

Yet another object of the invention is to provide a security mechanism which allows an Inspector to easily detect the improper functioning of the postage meter lever setting range.

The above objects are met by providing a value selection and printing apparatus including a printing device having a printing wheel; a moveable rack gear operatively engaged with the printing wheel such that at times when the rack gear moves along a normal linear operative path of travel the printing wheel is repositioned, the rack gear including a stress concentration area where the rack gear deforms when subject to a force sufficient to disassociate the printing wheel from the rack gear; and means, interfering with the deformed rack gear, for preventing the deformed rack gear from traversing the normal linear operative path of travel.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

Figure 1:
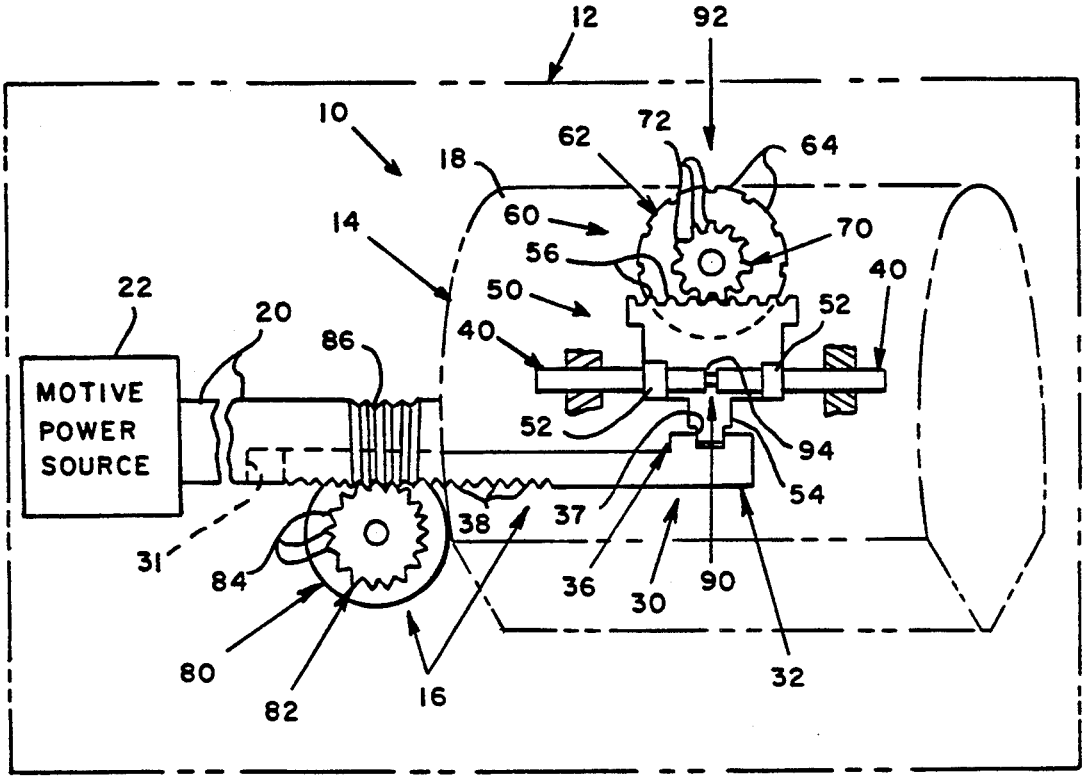
FIG. 1 (PRIOR ART)
FIG. 1 is a schematic view of a conventional rotary postage printing device, or equivalent structure, represented by a drum and a drive shaft therefor, including a value selection rack gear, print wheel and drive train therebetween, wherein the drive train includes a rack gear slidably mounted on a guide shaft.

The accompanying drawings wherein like reference numerals represent like or corresponding parts throughout the several views are incorporated in and constitute a part of the specification, illustrate a presently preferred embodiment of the invention, and together with the general description given above and the detailed description of the preferred embodiments given below, serve to explain the principles of the invention.

DESCRIPTION OF THE PREFERRED EMBODIMENT

As shown in FIG. 1, a value selection and printing mechanism 10 of the type which is used in a postage meter 12, generally includes value printing structure 14 and postage value selecting structure 16.

The postage value printing structure 14 includes a rotatable printing device or equivalent structure represented by a drum 18, and a drive shaft 20 for the drum 18. In addition, the printing structure 14 includes a conventional source of supply 22 of motive power, such as a conventional single revolution clutch or a conventional electronically controlled d.c. motor, which is suitably connected to the drive shaft 20 for rotation thereof. A more detailed description of the aforesaid typical printing structure 14 may be found in one or more of the aforesaid U.S. Pat. Nos. 4,050,374; 4,649,814; 4,630,210, and 3,682,378 or in other U.S. patents referred to therein.

The postage value selecting structure 16 includes an elongate, first, rack gear 30 which is conventionally slidably movably connected to the drive shaft 20, preferably as by nesting the rack gear 30 within a channel 31 formed in the drive shaft 20. The first rack gear 30 includes a first portion 32 of the longitudinal length thereof which is longitudinally movable internally of the printing drum 18, and a second portion 34 of the longitudinal length thereof, which is longitudinally movable externally of the drum 18. The internally movable portion 32 includes a driven element 36, which is preferably an element forming an aperture 37, such as a slot in the internally movable portion 32. The externally movable portion 34 includes a plurality of first gear teeth 38 formed therein longitudinally of the length thereof. The postage value selecting structure 16 additionally includes a rigid, guide, shaft 40, which is conventionally fixedly mounted within the printing drum 18. Moreover, the postage value selecting structure 16 includes an elongate second rack gear 50, which is conventionally slidably movably connected to the guide shaft 40, preferably, as by mounting the second rack gear in sliding engagement with the guide shaft 40. In this connection, the second rack gear 50 preferably includes a pair of oppositely-spaced, substantially tubularly-shaped, supporting portions 52 thereof, which are aligned axially with one another longitudinally of the length of the second rack gear 50 and slidably mounted on the guide shaft 40 at spaced intervals therealong. The second rack gear 50 includes a driving element 54 thereof, which is preferably a tang portion extending therefrom laterally of the longitudinal length thereof. The first rack gear's driven element 36 and second rack gear's driving element 54 are preferably conventionally cooperatively configured for engagement with one another, to permit the transmission of motive power from the first to the second rack gears, 30, 50. As thus constructed and arranged the second rack gear 50 is slidably translated along the guide shaft 40 in response to translation of the first rack gear 30. In addition, the second rack gear 50 includes a plurality of second gear teeth 56 therein longitudinally of the length thereof. Moreover, the postage value selecting structure 16 includes a postage value printing wheel 60. The printing wheel 60 includes a circumferentially extending periphery 62, and includes a plurality of printing elements or fonts 64 which are located at spaced intervals about the periphery 62. In the postage value printing environment herein discussed, the printing fonts 64 includes, for example, the numerals 1 through 9, and include a numeral zero or graphic symbol, and a black or period element. The printing elements 64 are respectively movable, in response to rotation of the print wheel 60, to a printing position externally of the postage printing drum 18. Further, the postage value selecting structure 16 preferably includes a pinion gear 70 having a plurality of circumferentially-extending gear teeth 72. The pinion gear 70 is conventionally coaxially, fixedly, attached to the value printing wheel 60 for rotation thereof in response to rotation of the pinion gear 70, and the gear teeth 72 are disposed in meshing engagement with the second rack gear teeth 56 for rotating the print wheel 60 in response to translation of the second rack gear 50 by the first rack gear 30. Still further, for translating the first rack gear 30, the postage value selection structure 16 includes conventional structure 80 for driving the first rack gear 30 including a pinion gear 82 having gear teeth 84 disposed in meshing engagement with the first rack gear teeth 38. Without departing from the spirit and scope of the invention, the driving structure 80 may be a stepper motor, d.c. motor or manually actuatable structure for driving the pinion gear 82, as for example, is set forth in the previously referenced U.S. patents. The drum drive shaft 20 includes a plurality of circumferentially-extending gear-tooth-shaped grooves 86 formed in the outer periphery thereof to permit the drum drive shaft 20 to rotate in engagement with the rack translating pinion gear 82.

The postage value selection structure 16 (FIGS. 1 and 2) includes structure 90 for weakening the guide shaft 40 against the application of a force 92 exerted against the printing wheel 60 which is sufficient to disassociate the printing wheel 60 from the second rack gear teeth 56. More particularly, the value selection structure 70 includes at least one circumferentially-extending channel 94 formed in the guide shaft 40 for weakening the rigidity of the guide shaft 40 against the application of force 92 to permit the guide shaft 40 to bend, as illustrated by the dashed-line presentation of the guide shaft 40 in FIG. 2, in response to the force 92, whereby the second rack gear 50 will become jammed against slidable movement thereof on the guide shaft 40. That is, the supporting portions 52 of the second gear rack 50 will not be able to slide along the bent guide shaft 40, but will jam against the guide shaft 40 when the printing wheel 60 is attempted to be moved.

While the above described device of U.S. Pat. No. 5,295,433 is generally effective, the instant invention provides a simple alternative for inhibiting the ability to print incorrect postage as well as a very easy way of detecting if the meter lever setting range has been tampered with or damaged.

Figure 3:
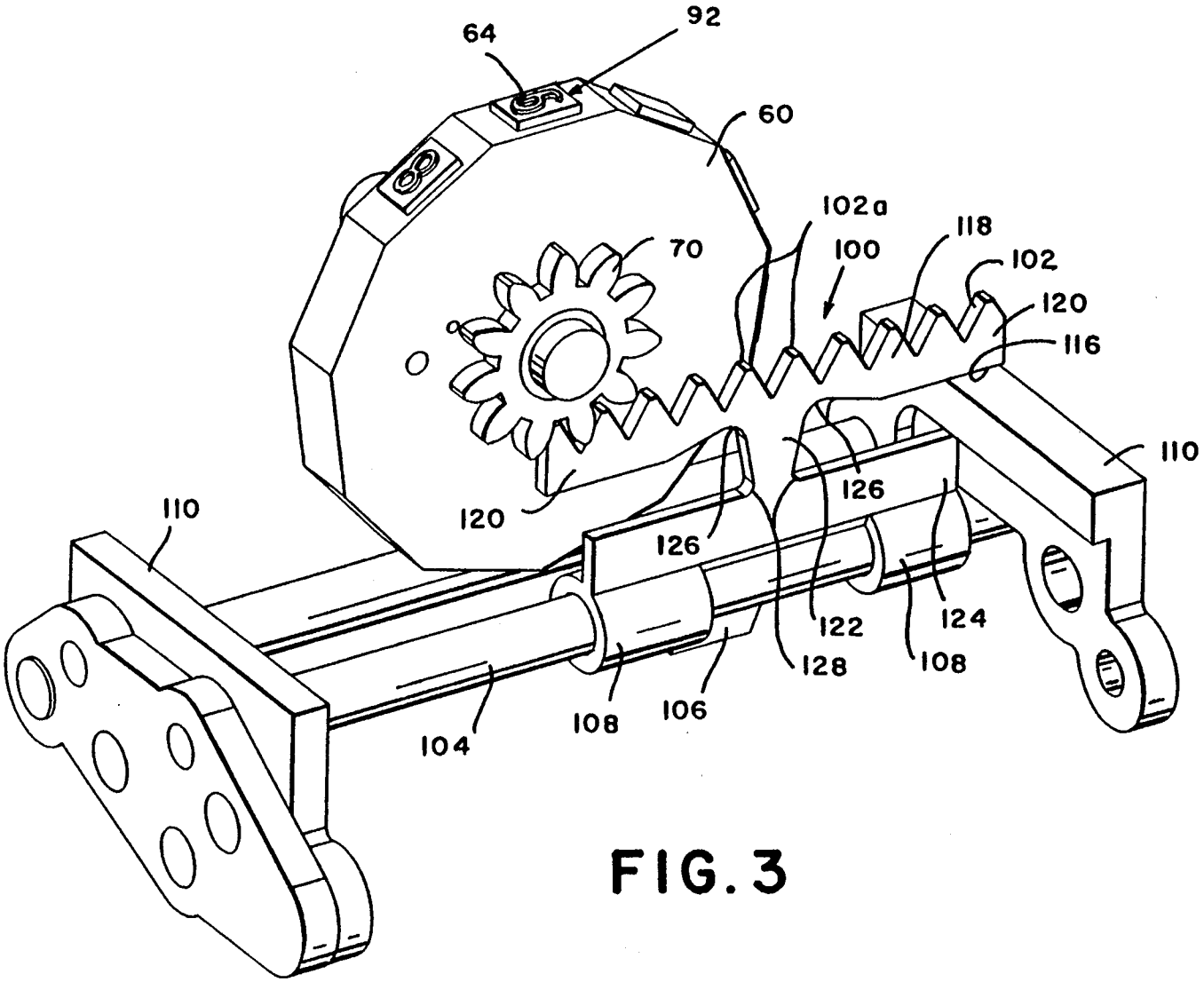
FIG. 3 is an enlarged perspective view of the inventive value selection rack gear.
Figure 4:
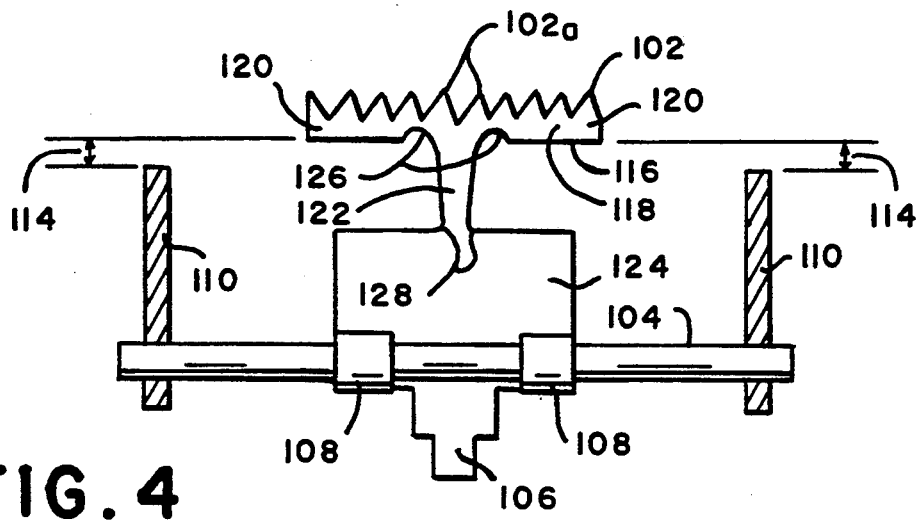
FIG. 4 is a side view of the inventive value selection rack gear of FIG. 4 in a normal operating position.

Referring to FIGS. 3 and 4, the inventive security device includes rack gear 100 having a plurality of teeth 102 thereon and being slidably mounted on a guide rod 104 which is conventionally mounted to a printing drum (not shown). While only one rack gear 100 is shown, a plurality of guide rods 104 each having a corresponding rack gear 100 mounted thereon could be utilized depending upon the number of printing wheels 60 of the printing device. Thus, the inventive device can include only a single rack gear 100 or any plurality of such rack gears.

In order to simplify the discussion of the inventive device and to preclude repeating information previously set forth in connection with FIGS. 1 and 2, it is sufficient to note that rack gear 100 operates in conjunction with printing wheel 60, pinion gear 70, and first rack gear 30 in a similar manner as second rack gear 50 of FIGS. 1 and 2. Rack gear 100 is thus operatively connected to a first rack gear 30 (not shown in FIG. 3) via driving element 106 and slides along guide rod 104 via supporting portions 108. Driving element 106 and supporting portions 108 are substantially the same as driving element 54 and supporting portions 52, respectively, of FIGS. 1 and 2.

End stops 110 can be an integrally formed extension of a printing drum (not shown) or can be connected thereto in a conventional manner. As best reflected in FIG. 4, ends stops 110 are located such that a clearance 114 exists between a bottom surface 116 of a top portion 118 of rack gear 100. Thus, during a normal path of travel of rack gear 100, end portions 120 of top portion 118 are free to pass over end stops 110, as shown in FIGS. 3, 4.

Figure 2:
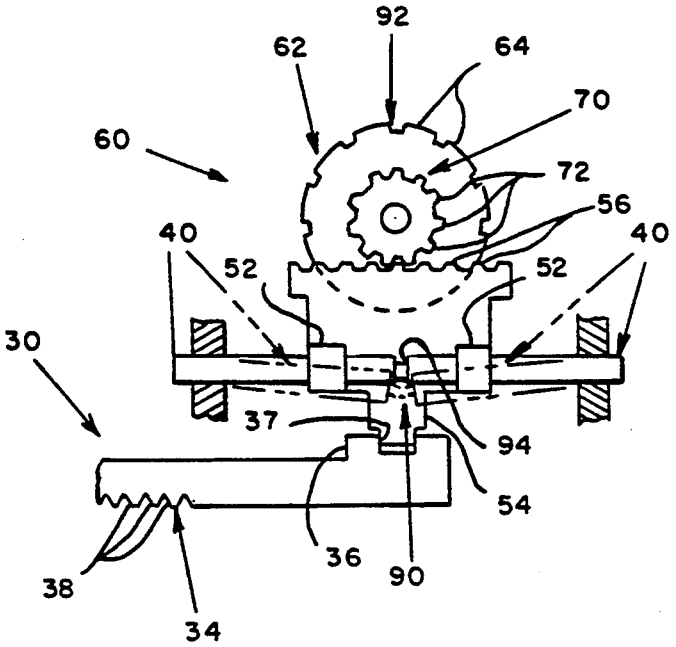
FIG. 2 (PRIOR ART)
FIG. 2 is a side view of the value selection rack gear, print wheel and drive train of FIG. 1, wherein the guide shaft has been weakened to bend in response to a predetermined force applied to the print wheel.

Referring to FIGS. 3–6, rack gear 100 differs in structure from second rack gear 50 of FIGS. 1 and 2 in that it has been intentionally structurally weakened by forming it in a substantially I-shaped configuration. The I-shaped form includes top portion 118 having the teeth 102 thereon, intermediate portion 122, and base portion 124 including driving element 106 and supporting portions 108. The I-shaped form can be created, for example, by removing or undercutting material from the body 50*a* of second rack gear 50. The I-shaped rack gear 100 has first stress concentration areas 126 disposed proximate to the roots of two central teeth 102*a*, and second stress concentration areas 128 located at the intersection of intermediate portion 122 and base portion 124.

Figure 5:
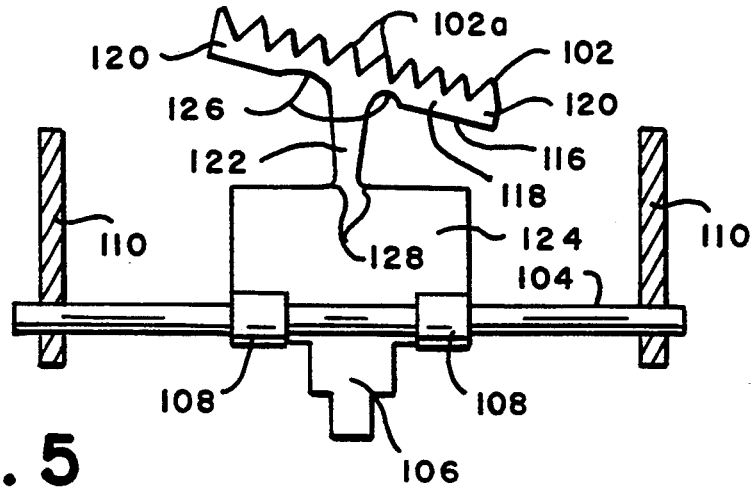
FIG. 5 is a side view of the inventive value selection rack gear of FIG. 4 in a first deformed position.
Figure 6:
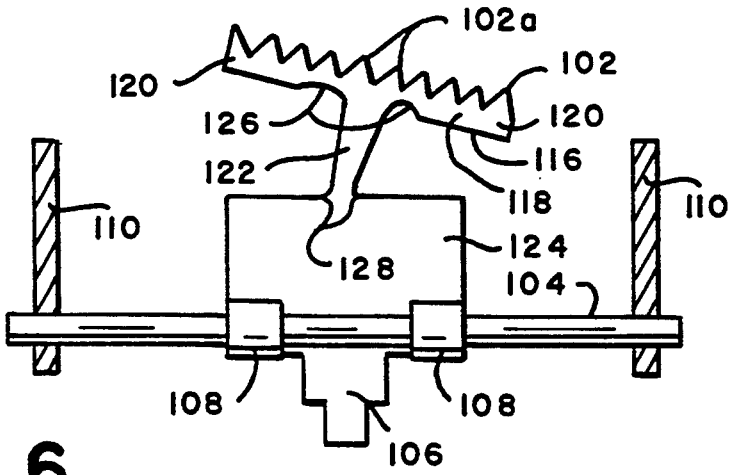
FIG. 6 is a side view of the inventive value selection rack gear of FIG. 4 in a second deformed position.

In operation, when a force, such as force 92 of FIGS. 1 and 3, which is sufficient to disassociate the print wheel 60 and rack gear 100, is applied to the print wheel 60, rack gear 100 will permanently deform as shown in either FIGS. 5 and 6 depending upon the location of the force relative to the rack gear 100. That is, if the force acts on any but the two central teeth 102*a*, rack gear 100 will permanently deform at the first stress concentration areas 126 as shown in FIG. 5. On the other hand, if the force acts on the two central teeth 102*a*, rack gear 100 will permanently deform at the second stress concentration areas 128 as shown in FIG. 6. Moreover, depending upon the magnitude and orientation of the force 92, deformation at both the first and second stress concentration areas 126 and 128 may occur. In either situation, FIGS. 5 and 6 show that due to the permanent deformation, the clearance 114 between top portion 118 and one of the end stops 110 no longer exists such that an interference exists between the top portion 118 and end stop 110, thereby preventing end portion 120 of rack gear 100 from passing over a corresponding end stop 110. Thus, the normal path of travel of rack gear 100 is now limited, preventing the printing of certain postage values and providing an easy way of detecting the improper operation of the postage meter.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A value selection and printing apparatus comprising:

a printing device including a printing wheel;

first and second end stops connected to said printing device; and a rack gear having first and second parts and being moveable along a normal path of travel between said first and second end stops such that said first and second parts of said rack gear are respectively adapted to be positioned beyond said first and second end stops, said rack gear being operatively engaged with said printing wheel to reposition said printing wheel at times when said rack gear moves along said normal path of travel;

wherein said rack gear includes a first weakened area such that at times when a force sufficient to disassociate said printing wheel from said rack gear is exerted against said printing wheel, said rack gear deforms at said first weakened area preventing one of said first and second parts from being positioned beyond a corresponding one of said first and second end stops.

2. A value selection and printing apparatus as set forth in claim 1, wherein said rack gear is substantially I-shaped to include a top portion, a bottom portion and an intermediate portion connecting said top and bottom portions.

3. A value selection and printing apparatus as set forth in claim 2, wherein said first weakened area is located at the intersection of said top and intermediate portions.

4. A value selection and printing apparatus as set forth in claim 3, wherein said rack gear includes a second weakened area located at the intersection of said bottom and intermediate portions, said rack gear being deformable at said second weakened area in response to said force such that said one of said first and second parts is prevented from being positionable beyond said corresponding one of said first and second end stops.

5. A value selection and printing apparatus as set forth in claim 4, wherein said rack gear has a plurality of teeth along said top portion including two central teeth substantially aligned with said intermediate portion, at times when said force is applied to any of said plurality of teeth except said two central teeth said rack gear deforms at said first weakened area, and at times when said force is applied to either of said two central teeth said rack gear deforms at said second weakened area.

6. A value selection and printing apparatus as set forth in claim 5, further comprising means for driving said rack gear along said normal path of travel.

7. A value selection and printing apparatus as set forth in claim 6, further comprising a guide rod connecting said first and second end stops, and wherein said rack gear is slidably mounted on said guide rod to slide along said normal path of travel between said first and second end stops.

8. A value selection and printing apparatus comprising:

a printing device including a printing wheel;

a movable rack gear operatively engaged with said printing wheel such that at times when said rack gear moves along a normal linear operative path of travel said printing wheel is repositioned, said rack gear including a stress concentration area where said rack gear deforms when subjected to a force sufficient to disassociate said printing wheel from said rack gear; and means, interfering with said deformed rack gear, for preventing said deformed rack gear from traversing said normal linear operative path.

9. A value selection and printing apparatus as set forth in claim 8, wherein said rack gear is substantially I-shaped including top and bottom portions and an intermediate portion connecting said top and bottom portions.

10. A value selection and printing apparatus as set forth in claim 9, wherein said stress concentration area is located at the intersection of said top and intermediate portions.

11. A value selection and printing apparatus as set forth in claim 9, wherein said stress concentration area is located at the intersection of said bottom and intermediate portions.

12. A value selection and printing apparatus as set forth in claim 8, further comprising a guide rod connected to said printing device and having said rack gear slidably mounted thereon, and means for driving said rack gear along said guide rod over said normal linear operative path of travel.

* * * * *